US008295519B2

(12) United States Patent
Elmedyb et al.

(10) Patent No.: US 8,295,519 B2
(45) Date of Patent: Oct. 23, 2012

(54) CODEBOOK BASED FEEDBACK PATH ESTIMATION

(75) Inventors: Thomas Bo Elmedyb, Smørum (DK); Jesper Jensen, Smørum (DK)

(73) Assignee: Oticon A/S, Smorum (DK)

( * ) Notice: Subject to any disclaimer, the term of this patent is extended or adjusted under 35 U.S.C. 154(b) by 596 days.

(21) Appl. No.: 12/506,793

(22) Filed: Jul. 21, 2009

(65) Prior Publication Data

US 2010/0020996 A1 Jan. 28, 2010

(30) Foreign Application Priority Data

Jul. 24, 2008 (EP) ..... 08104854

(51) Int. Cl.
*H04R 25/00* (2006.01)

(52) U.S. Cl. ..... 381/318; 381/93; 381/95; 381/96; 381/101; 381/312; 379/406.11

(58) Field of Classification Search ..... 381/93, 381/95, 96, 101, 318, 94.1, 312, 313, 317, 381/23.1, 57; 379/406.01
See application file for complete search history.

(56) References Cited

U.S. PATENT DOCUMENTS 5,276,739 A * 1/1994 Krokstad et al. ..... 381/318
6,160,893 A * 12/2000 Saunders et al. ..... 381/71.6
(Continued)

FOREIGN PATENT DOCUMENTS

EP 0 250 679 A2 1/1988
(Continued)

OTHER PUBLICATIONS

Wyrsch et al., "Adaptive Feedback Cancelling in Subbands for Hearing Aids", 1999 IEEE International Conference on Acoustics, Speech, and Signal Processing, Phoenix, AZ, Mar. 15-19, 1999, vol. 2, pp. 921-924, XP010328511.

*Primary Examiner* — Davetta W Goins
*Assistant Examiner* — Kuassi Ganmavo
(74) *Attorney, Agent, or Firm* — Birch, Stewart, Kolasch & Birch, LLP

(57) ABSTRACT

The invention relates to a hearing instrument for processing an input sound to an output sound according to a user's needs. The invention further relates to a method of operating a hearing instrument and to use of a hearing instrument. The object of the present invention is to provide an alternative scheme for handling acoustic feedback in a hearing instrument. The problem is solved in that an input transducer for converting an input sound to an electric input signal and an output transducer for converting a processed electric output signal to an output sound, a forward path being defined between the input transducer and the output transducer, a feedback cancellation system for estimating the effect of acoustic feedback from the output transducer to the input transducer, the feedback cancellation system comprising a variable pre-estimated filter and a memory wherein a number of predetermined feedback channel impulse responses corresponding to a number of acoustic environments where substantial feedback is experienced are stored, and wherein the hearing instrument comprises a monitoring unit that—based on the current acoustic environment—is adapted to choose the currently most appropriate impulse response of the variable pre-estimated filter among the stored impulse responses. This has the advantage of providing a scheme for handling acoustic feedback that can adapt relatively fast to changing acoustic environments. The invention may e.g. be used in listening devices, such as hearing aids, head sets or active ear plugs, wherein customized feedback compensation is an issue.

16 Claims, 5 Drawing Sheets

U.S. PATENT DOCUMENTS

| | | | | |
|---|---|---|---|---|
| 6,181,794 | B1 * | 1/2001 | Park et al. | 379/406.08 |
| 6,219,427 | B1 * | 4/2001 | Kates et al. | 381/318 |
| 6,282,176 | B1 * | 8/2001 | Hemkumar | 370/276 |
| 6,404,895 | B1 * | 6/2002 | Weidner | 381/318 |
| 6,754,356 | B1 * | 6/2004 | Luo et al. | 381/318 |
| 6,831,986 | B2 * | 12/2004 | Kates | 381/312 |
| 6,876,751 | B1 | 4/2005 | Gao et al. | |
| 7,020,297 | B2 * | 3/2006 | Fang et al. | 381/317 |
| 7,519,193 | B2 * | 4/2009 | Fretz | 381/312 |
| 7,756,283 | B2 * | 7/2010 | Bramslow | 381/318 |
| 7,826,631 | B2 * | 11/2010 | Fischer et al. | 381/312 |
| 7,894,598 | B2 * | 2/2011 | Schmidt et al. | 379/406.07 |
| 2003/0026442 | A1 * | 2/2003 | Fang et al. | 381/318 |
| 2006/0222194 | A1 | 10/2006 | Bramslow et al. | |
| 2007/0049788 | A1 * | 3/2007 | Kalinowski et al. | 600/23 |
| 2007/0055505 | A1 * | 3/2007 | Doclo et al. | 704/226 |
| 2008/0025527 | A1 * | 1/2008 | Haulick et al. | 381/93 |
| 2008/0085013 | A1 * | 4/2008 | Somasundaram | 381/95 |

FOREIGN PATENT DOCUMENTS

| | | | |
|---|---|---|---|
| EP | 1 439 736 | A1 | 7/2004 |
| EP | 1 273 205 | B1 | 6/2006 |
| WO | WO-97/15124 | A1 | 4/1997 |
| WO | WO-99/26402 | A1 | 5/1999 |
| WO | WO-2005/096670 | A1 | 10/2005 |
| WO | WO-2008/000843 | A2 | 1/2008 |

* cited by examiner

CODEBOOK BASED FEEDBACK PATH ESTIMATION

TECHNICAL FIELD

The present invention relates to estimation of acoustical feedback in listening devices, such as hearing aids. The invention relates specifically to a hearing instrument for processing an input sound to an output sound according to a user's needs.

The invention furthermore relates to a method of operating a hearing instrument for processing an input sound to an output sound according to a user's needs. The invention also relates to use of a hearing instrument, to a software program and to a computer readable medium having instructions stored thereon.

The invention may e.g. be useful in listening devices, such as hearing aids, head sets or active ear plugs, wherein customized feedback compensation is an issue.

BACKGROUND ART

The following account of the prior art relates to one of the areas of application of the present invention, hearing aids.

In hearing aids, acoustic feedback from the receiver to the microphone(s) may give rise to signal degradations or even howl if not dealt with. Often, to reduce this problem, an adaptive feedback cancelling algorithm is used, which estimates the feedback channel transfer function using adaptive filtering techniques such as LMS, RLS, etc. The actual feedback transfer function is determined by physical parameters such as relative location of the microphone and receiver, jaw movements, actions by the hearing aid user (telephone-to-ear, hug, etc.), and generally distance to reflecting objects, walls, etc. When the actual feedback transfer function changes slowly, and the gain applied in the hearing aid is not too high, standard adaptive schemes like LMS are adequate. However, in practice, this is often not the case, and the standard adaptive algorithms fail to track the changing feedback channel.

DISCLOSURE OF INVENTION

In general, the number of different relevant actual feedback transfer functions experienced by a particular hearing aid user depends on the user's behaviour, occupation, etc. and can be any number. It is proposed to measure (off-line) typical or average actual feedback channels and collect the corresponding impulse responses. In particular we propose to generate a codebook of plausible feedback channel impulse responses, or any equivalent representation, e.g. complex-valued transfer functions, filter coefficients, etc., and to make them available for selection and use in the appropriate listening situation, e.g. by storing them in a memory of the hearing aid accessible from a signal processing unit of the hearing aid. The collected impulse responses (or equivalent representations) could be exploited in a setup as illustrated in FIG. 1.

An object of the present invention is to provide an alternative scheme for handling acoustic feedback in a hearing instrument. An advantage of an embodiment of the present invention is that it is relatively simple to implement. A further advantage of an embodiment of the present invention is that it can be specifically adapted to a particular user's normal acoustic environments.

Objects of the invention are achieved by the invention described in the accompanying claims and as described in the following.

An object of the invention is achieved by a hearing instrument for processing an input sound to an output sound according to a user's needs. The hearing instrument comprises an input transducer for converting an input sound to an electric input signal and an output transducer for converting a processed electric output signal to an output sound, a forward path being defined between the input transducer and the output transducer, a feedback cancellation system for estimating the effect of acoustic feedback from the output transducer to the input transducer, the feedback cancellation system comprising a variable pre-estimated filter and a memory wherein a number of predetermined feedback channel impulse responses corresponding to a number of acoustic environments where substantial feedback is experienced are stored, and wherein the hearing instrument comprises a monitoring unit that—based on the current acoustic environment—is adapted to choose the currently most appropriate impulse response of the variable pre-estimated filter among the stored impulse responses.

This has the advantage of providing a scheme for handling acoustic feedback that can adapt relatively fast to (even relatively large) changes in the acoustic environment.

In general, the number of predetermined feedback channel impulse responses stored in the memory is one or more. In a particular embodiment, the number is one. This estimate could e.g. represent the static contribution to the feedback path from e.g. microphone, receiver, possible A/D and D/A converters, etc. The static contribution can be e.g. measured and stored during the fitting process. Alternatively, the number of predetermined feedback channel impulse responses stored in the memory is at least two, such as in the range from 2 to 10, e.g. in the range from 3 to 5. In another embodiment, the number of predetermined feedback channel impulse responses stored in the memory is smaller than 256, such as smaller than 50, e.g. smaller than 20.

In a particular embodiment, the signal path comprises an element, e.g. a filter bank (or an equivalent element, such as a variable filter), for splitting the electric input signal in a number of frequency bands or ranges. In the present context, the term 'frequency bands' is typically used, but terms like 'frequency range', 'frequency area', etc. might interchangeably be used.

In a particular embodiment, the forward path comprises a signal processing unit adapted for providing a frequency dependent gain, e.g. by processing signals from a number of frequency bands, and for providing a processed output signal.

In a particular embodiment, the feedback cancellation system comprises a feedback path estimation unit, e.g. in the form of an adaptive FBC (Feedback Cancellation) filter, for dynamically estimating current acoustic feedback in the hearing instrument. In a particular embodiment, the feedback path estimation unit (e.g. the adaptive FBC filter) and the variable pre-estimated filter work in parallel.

In an embodiment, the hearing instrument is adapted to allow a choice to be made between using the feedback path estimation unit for dynamically estimating current acoustic feedback and using the variable pre-estimated filter with the chosen currently most appropriate impulse response. In an embodiment, the system is adapted to make an interpolation between at least two pre-estimated impulse responses to arrive at an impulse response that is currently more appropriate than the at least two pre-estimated impulse responses.

When only a feedback path estimation unit (e.g. an adaptive FBC filter) is used (i.e., without the proposed code book solution using the variable pre-estimated filter) for estimating the feedback path transfer function, the accuracy of the estimate will vary across frequency (and time) depending on several factors such as the tonality of the input signal, the gain in the forward path, the power of the input signal, etc. For example, it is known that the accuracy of the estimate will be relatively high in spectral regions where the receiver (output) signal is powerful compared to the input signal, or equivalently, in spectral regions where the gain applied in the forward path is high. The impact of the factors that influence the accuracy of the estimate is not completely known at all times, but can be estimated. It is therefore possible to determine in which frequency regions the feedback path estimate will be reliable and in which the estimate will be less reliable. Consequently, it is potentially advantageous to use the feedback path estimate of the feedback path estimation unit (e.g. an adaptive FBC filter) in spectral regions where it can be considered reliable, but to use a codebook based estimate in regions where the feedback path estimate would otherwise be unreliable.

In an embodiment, the feedback cancellation is adapted to—in particular situations, based on a predefined criterion (e.g. based on an estimate of the reliability of the feedback path estimate of the feedback path estimation unit)—rely only on an estimate of the feedback path from the feedback path estimation unit. This is advantageous in the case where the user is not in a typical situation for which the proposed codebook based solution is tailored. Thus, this can be seen as a 'safety net' solution.

In a particular embodiment, the hearing instrument is adapted to estimate acoustic feedback by the feedback path estimation unit in at least one of the frequency bands and by the variable pre-estimated filter in at least one of the other frequency bands.

In a particular embodiment, the hearing instrument is adapted to determine frequency bands with signal energy below a predetermined value, and to estimate the transfer function of the feedback path by the variable pre-estimated filter in such frequency band(s) and by the adaptive FBC filter in the other frequency bands. Measuring average energy or power within frequency bands can easily be realized, e.g. by a 1-pole IIR long-term averaging filter applied to magnitude-squared time samples $|x_i(n)|^2$ within each sub band, indexed by i, of the forward signal path. A threshold value could e.g. be 40 dB SPL (SPL=Sound Pressure Level). x(n) represents the digital signal of (i.e. somewhere in) the forward path, where n is a discrete-time index and $x_i(n)$ (i=1, 2, . . . , K) represent the time varying input signal in subband i. Alternatively, one could monitor the (average) gain applied in one or more sub bands, such as in each sub band, in the forward path and decide to use the feedback path estimate provided by the variable pre-estimated filter in spectral regions where the gain is below a certain threshold, say 0 dB. Other appropriate values, e.g. 20 dB may be used, depending on the actual application.

In a particular embodiment, the hearing instrument is adapted to determine frequency bands that are reliable and frequency bands that are unreliable e.g. due to feedback, auto-correlation, or the like, and to estimate acoustic feedback in the reliable frequency bands by the adaptive FBC filter and to use the estimated feedback transfer function in the reliable frequency bands to find the most appropriate impulse response of the variable pre-estimated filter among the stored impulse responses and to use this to estimate the transfer function in the unreliable frequency bands.

In the present context, a 'hearing instrument' (also interchangeably termed a 'hearing aid') may be of any appropriate kind, such as an in-the-ear (ITE), such as an in-the-canal (ITC), such as a completely-in-canal (CIC), such as a behind-the-ear (BTE), or such as a receiver-in-the-ear (RITE) hearing instrument. The parts of a hearing instrument according to the present invention are body worn and can be located in a common housing and e.g. worn behind the ear (BTE) or in the ear canal, or alternatively be located in different housings, one e.g. located in the ear canal another behind the ear or worn elsewhere on the body of the wearer. The communication between the two or more housings can be acoustical and or electrical and/or optical. The electrical and optical communication can be wired or wireless. In an embodiment, the input transducer and the variable pre-estimated filter are enclosed in the same physical unit and located e.g. behind an ear or in an ear canal. In an embodiment, the input transducer, the variable pre-estimated filter and the memory (wherein the predefined feedback channel impulse responses (or other equivalent representation) are stored) are enclosed in the same physical unit.

In another aspect, a method of operating a hearing instrument for processing an input sound to an output sound according to a user's needs is furthermore provided by the present invention, the method comprising a) converting an input sound to an electric input signal;

b) converting a processed electric output signal to an output sound;

c) estimating the effect of acoustic feedback from the output sound to the input sound;

d) providing said hearing instrument with a variable pre-estimated filter and a memory;

e) estimating a number of predetermined feedback channel impulse responses corresponding to a number of acoustic environments where acoustic feedback is experienced;

g) storing said predetermined feedback channel impulse responses in said memory;

h) monitoring the current acoustic environment; and i) choosing the currently most appropriate impulse response of the variable pre-estimated filter among the stored impulse responses from said memory.

The method has the same advantages as the hearing instrument outlined above. It is intended that the method can be combined with the same features as described for the system (appropriately converted to corresponding actions).

Preferably, the method further comprises the step of applying the chosen impulse response to the variable pre-estimated filter.

In a preferred embodiment, the method comprises the step of splitting the electric signal of the forward path into a number of frequency bands.

In a particular embodiment, the method comprises the step of dynamically estimating current acoustic feedback in the hearing instrument.

In a particular embodiment, the step of dynamically estimating acoustic feedback is performed in parallel to the step of estimating the feedback path by the pre-estimated filter.

In a particular embodiment, the method comprises the step of dynamically estimating acoustic feedback in at least one of the frequency bands and estimating acoustic feedback by the currently most appropriate pre-estimated impulse response in at least one of the other frequency bands.

In a particular embodiment, the method comprises the use of statistical models on the pre-determined impulse responses, e.g. in that corresponding average impulse responses and the variance of the impulse responses around their average are stored in the memory. In a particular embodiment, the method comprises the step of determining a minimum mean-square estimate or maximum a posteriori (MAP) estimate of the feedback channel impulse response based on the average impulse responses and the variance of the impulse responses around their average.

In a particular embodiment, the time-development of feedback channels is taken into account, e.g. by using Hidden Markov Models (HMMs) or equivalent statistical tools.

In a particular embodiment, the method comprises the step of updating the predetermined feedback channel impulse responses stored in the code book memory. By comparing current feedback estimates (or average feedback estimates) obtained by a dynamic feedback path estimation unit with the pre-estimated feedback estimates stored in the memory, the predetermined impulse responses can be updated over time according to a predefined criterion (e.g. if deviations are larger than a certain level) and/or update frequency (e.g. once every week or month or 3 months). This has the advantage of allowing to compensate for changing feedback conditions, e.g. due to changed conditions in an ear canal of a user, due to a child's growth, to the generation of ear wax, etc.

At least some of the features of the system and method described above may be implemented in software and carried out fully or partially on a signal processing unit of a hearing instrument caused by the execution of signal processor-executable instructions. The instructions may be program code means loaded in a memory, such as a RAM, or ROM located in a hearing instrument or another device via a (possibly wireless) network. Alternatively, the described features may be implemented by hardware instead of software or by hardware in combination with software.

Use of a hearing instrument as described above, in the section explaining 'mode(s) for carrying out the invention' in more detail and in the claims is moreover provided by the present invention.

In a further aspect, a software program for running on a signal processor of a hearing instrument is moreover provided by the present invention. When the software program implementing at least some of the steps of the method described above, in the detailed description of 'mode(s) for carrying out the invention' and in the claims, is executed on the signal processor, a solution specifically suited for a digital hearing aid is provided.

In a further aspect, a medium having instructions stored thereon is moreover provided by the present invention. The instructions, when executed, cause a signal processor of a hearing instrument as described above, in the detailed description of 'mode(s) for carrying out the invention' and in the claims to perform at least some of the steps of the method described above, in the detailed description of 'mode(s) for carrying out the invention' and in the claims.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1A:
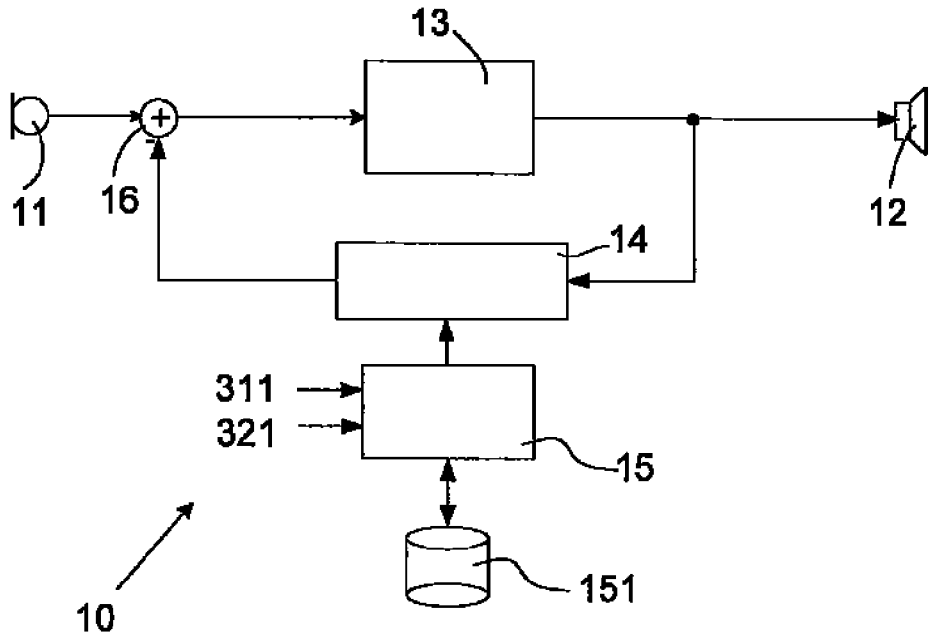
FIG. 1 shows block diagrams of first, second and third embodiments of a hearing instrument according to the invention.

FIG. 1*a* shows a simplified block diagram of a first embodiment of the present invention. The hearing instrument 10 comprises an input transducer 11 (here a microphone) for picking up an input sound and converting it to an electrical input signal, an output transducer 12 (here a receiver) for converting a processed output signal (here the output of signal processing unit 13) to an output sound, and a forward path comprising a signal processing unit 13 for adapting the input signal to a user's needs (possibly including noise reduction, directionality extraction, gain adaptation, compression, time to frequency conversion, etc.). The hearing instrument 10 further comprises a variable pre-estimated filter 14 and a memory 151 wherein a number of predetermined feedback channel impulse responses corresponding to a number of acoustic environments where substantial feedback is experienced are stored. The hearing instrument further comprises a monitoring unit 15, which is in communication with memory 151. Based on one or more inputs 311, 321 indicative of the current acoustic environment, the monitoring unit is adapted to choose the currently most appropriate impulse response among the impulse responses stored in the memory 151 and to load it to the variable pre-estimated filter 14. An input of the variable pre-estimated filter 14 is a processed output signal (here the output of signal processing unit 13). An output of the variable pre-estimated filter 14 is subtracted from the electrical input signal in summation unit 16, thereby closing the (first) electrical feedback loop.

Figure 1B:
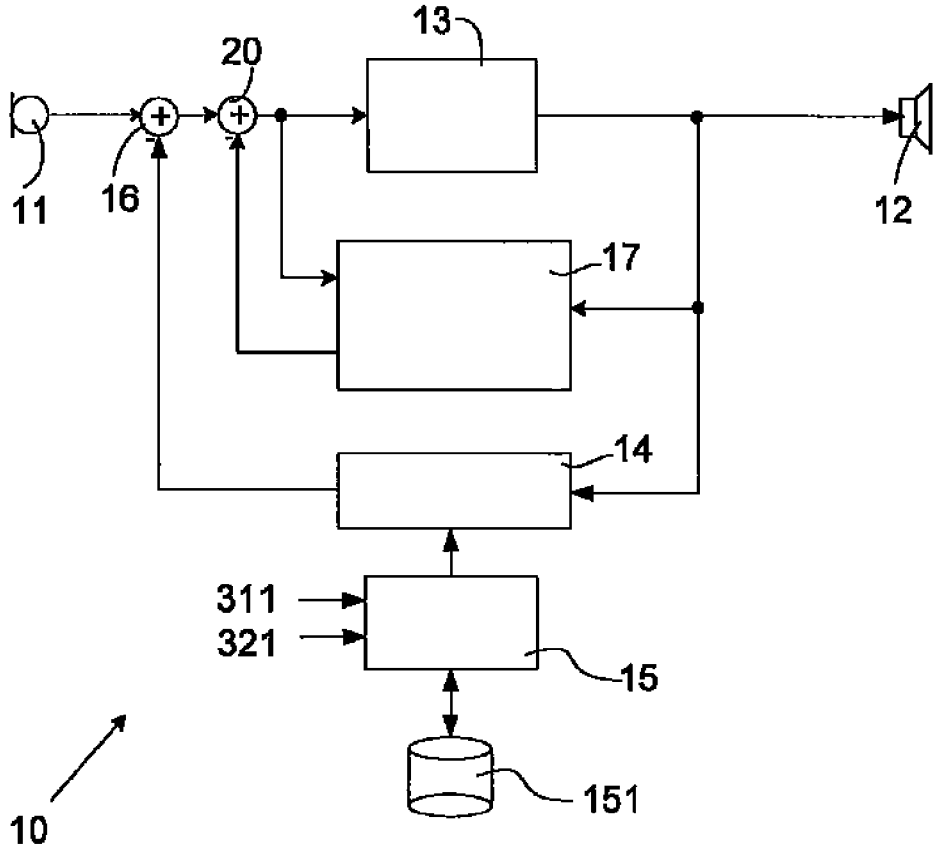

FIG. 1*b* shows a simplified block diagram of a second embodiment of the present invention. The hearing instrument 10 of FIG. 1*b* is identical to that of FIG. 1*a* apart from an additional feedback loop comprising a feedback path estimation unit 17 (e.g. in the form of an adaptive filter) working in parallel to the feedback loop comprising the variable pre-estimated filter 14. One input to the feedback path estimation unit 17 is a processed output signal (here the output of signal processing unit 13). Another input to the feedback path estimation unit 17 is the feedback corrected electrical input signal. An output of the feedback path estimation unit 17 is subtracted from the electrical input signal in summation unit 20, thereby closing the (second) electrical feedback loop.

Figure 1C:
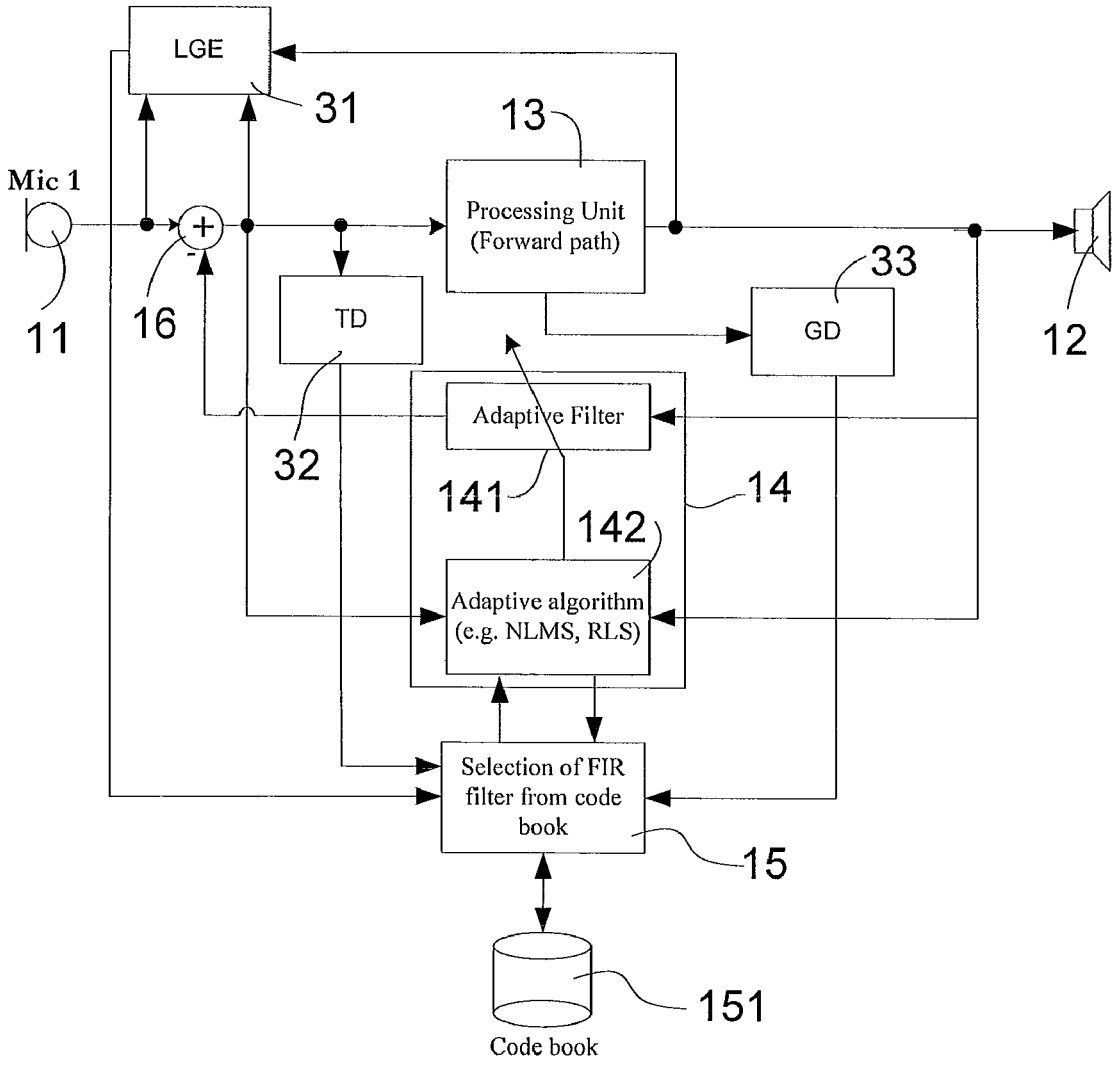

FIG. 1*c* shows a block diagram of a third embodiment of a hearing instrument according to the invention. The hearing instrument 10 comprises an input transducer 11 (here microphone, Mic 1) for picking up an input sound and converting it to an electrical input signal, an output transducer 12 (here receiver) for converting a processed output signal (here the output of signal processing unit 13) to an output sound, and a forward path comprising a signal processing unit 13 for adapting the input signal to a user's needs (Processing Unit (Forward path) block). The hearing instrument 10 further comprises variable filter 14, here in the form of an adaptive filter 141 (Adaptive Filter block), whose filter characteristics can be customized by an adaptive filter algorithm 142 (Adaptive algorithm (e.g. NLMS, RLS) block). The output of the signal processing unit 13 is used as input to the receiver 12 and as 'reference signal' to the variable filter (here, to the filter part 141 as well as to the algorithm part 142). The output of the filter part 141 of the variable filter is added to the electric input signal from the microphone in adding unit 16 to provide a feedback corrected input signal. This resulting 'error' signal is used as input to the signal processing unit 13 and to the algorithm part 142 of the variable filter. The hearing instrument 10 further comprises a monitoring unit 15 block Selection of FIR filter from code book in FIG. 1) adapted to communicate with a memory 151, wherein predetermined feedback channel impulse responses (or any other appropriate representation) corresponding to a number of acoustic environments where substantial feedback is experienced are stored. The monitoring unit 15 is adapted to choose the currently most appropriate impulse response of the variable pre-estimated filter 14 among the stored impulse responses in the memory and to apply the selected one to the variable filter 14. In the embodiment of FIG. 1, the monitoring unit 15 receives inputs from the algorithm part 142 of the variable filter and from detectors 31, 32, 33, and based thereon, an appropriate impulse response is selected and fed to the algorithm part 142 and applied to the filter part 141 of the variable filter 14, thereby overriding the filter coefficients determined by the algorithm part itself. In an embodiment, the system is adapted to gradually update the filter coefficients in the filter part, e.g. by fading from one set of values to another with a predetermined fading rate. The filter part 141 can be implemented as any convenient variable filter, e.g. a FIR or an IIR filter. The algorithm part 142 can be implemented as any convenient adaptive algorithm such as LMS, RLS, etc. The detectors supply information about the current input signal and the current gain settings in the forward path and thus provide inputs about the current acoustic environment to be used in the decision of choosing the most appropriate impulse response for the feedback loop. The monitoring unit 15 is adapted to decide whether the variable filter part 141 is updated with the filter coefficients determined by the algorithm part 142 (based on the current values of the input signals to the algorithm part) OR is updated based on a selected one of the predefined impulse responses stored in the memory 151 (which may or may not form part of the monitoring unit 15). The selection of one update source over the other is e.g. based on the information gathered from various detectors from which the reliability of the existing feedback path estimate can be judged. If, e.g., the estimate from the algorithm part 142 is judged largely unreliable, a predefined impulse response is used instead. In an embodiment, the signal of the forward path is split into a number of frequency bands (e.g. by a filter bank), and the monitoring unit 15 is adapted to update the variable filter part 141 in at least one frequency band based on the currently determined values of the adaptive algorithm in the algorithm part 142 AND to update the variable filter part 141 in at least one frequency band based on a selected one of the predefined impulse responses stored in the memory of monitoring unit 15. The selection of one update source over the other for a given frequency band is e.g. based on the information gathered from various detectors from which the reliability of the existing feedback channel estimate for various frequency regions, can be judged. In the embodiment of FIG. 1, three detectors are used, the first is a loop gain estimator 31 (LGE) providing an estimate of current loop gain (indicating the quality/reliability of the current feedback channel estimate as a function of frequency). The second is a tonal detector 32 (TD) for detecting tonal components in the forward path (indicating which frequency regions of the feedback channel estimate may be biased and consequently not reliable), and the third is a gain detector 33 (GD) for detecting current forward gain (the feedback channel estimate in frequency regions with low forward gain tend to be unreliable). The loop gain estimator 31 (LGE), here taking inputs from various different stages of the forward path, can e.g. be implemented as described in Kaelin, Lindgren and Wyrsch, "A digital frequency-domain implementation of a very high gain hearing aid with compensation for recruitment of loudness and acoustic echo cancellation," Elsevier Signal Processing, vol. 64, pp. 71-85, 1998. The tonal detector 32 (TD), here taking as an input the feedback corrected input signal, can e.g. be implemented as described in WO 2008/051570 or in WO 01/06812 A1. The gain detector 33 (GD), here assumed to be calculated in the signal processing unit 13, can e.g. be implemented by adding all gains applied by various algorithms in the forward path, e.g. directional system, noise reduction system, etc. It should be understood that the chosen set of detectors only serve as an example. In practice, other detectors could be in play as well or instead.

Adaptive filters and appropriate algorithms are e.g. described in Ali H. Sayed, Fundamentals of Adaptive Filtering, John Wiley & Sons, 2003, ISBN 0-471-5 46126-1, cf. e.g. chapter 5 on Stochastic-Gradient Algorithms, pages 212-280, or Simon Haykin, Adaptive Filter Theory, Prentice Hall, 3rd edition, 1996, ISBN 0-13-322760-X, cf. e.g. Part 3 on Linear Adaptive Filtering, chapters 8-17, pages 338-770.

Figure 4:
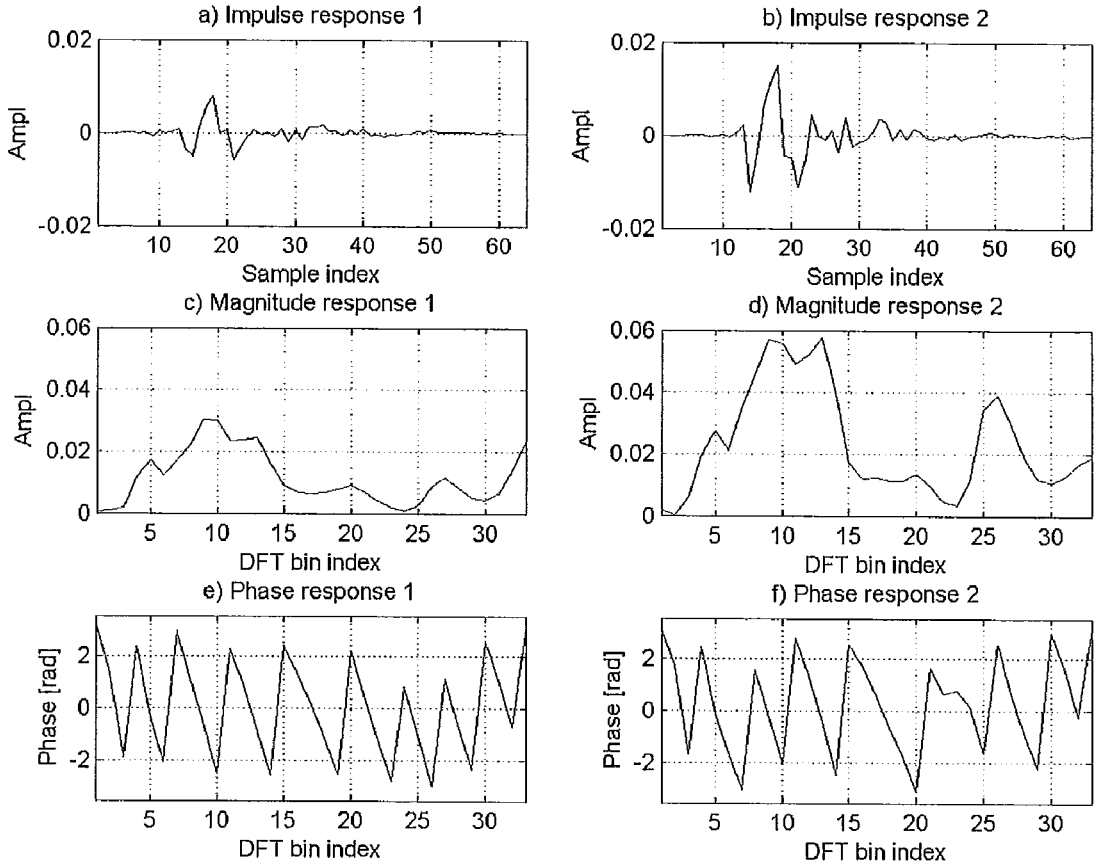
FIG. 4 shows an example of an impulse responses stored in a code book of a hearing instrument according to an embodiment of the invention.

FIG. 4 shows an example of a simplified code book of an embodiment of a hearing instrument according to the invention. In this particular case, the code book consists of two amplitude vs. time impulse responses shown in FIG. 4*a* and 4*b*, which each consists of a number of, e.g. 64, real-valued time samples, the time parameter being represented by a 'sample index' (1-64). An alternative, but equivalent representation would be the discrete Fourier transform of the two impulses. In that case the each impulse response is represented using a magnitude spectrum (amplitude vs. 'bin index'), FIG. 4*c* and 4*d*, and a phase spectrum (phase vs. 'bin index'), FIGS. 4*e* and *f*. One advantage of using the latter representation is that howls are typically constrained to certain frequency regions, which are easier to handle in the spectral representation of FIG. 4*c*-4*d*.

In one embodiment of the proposed setup, the feedback channel impulse response is in general estimated by any of the standard algorithms (e.g. NLMS/RLS, etc.). Since in some spectral regions—at a given time—, the output signal energy is relatively low, the variance of the feedback path estimate (provided by an adaptive filter, e.g. 14 in FIG. 1) is high in such frequency regions. The poor estimate quality in such frequency region can be improved e.g. simply by replacing the feedback transfer function in this frequency region with the 'closest' (in some appropriate distance measure) impulse response in the code book.

In a particular embodiment, the proposed code book approach can be used for more advanced statistical models, where e.g. a minimum mean-square estimate or maximum a posteriori (MAP) estimate of the feedback channel impulse response is formed using the pre-collected impulse responses. This could be realized by not only storing pre-collected average impulse responses (or equivalently feedback transfer functions) in the codebook, but also storing the (co-) variance of the impulse responses around their average. This could for example be implemented using Gaussian mixture models (GMMs), where each codebook entry is now described by a linear combination of multi-dimensional Gaussian probability density functions. With this setup it is possible to compute at each time instant the MAP probability that a given member of the code book 'generated' the observed data. Doing this for each and every entry of the code book makes it possible to choose the particular impulse response representation with the highest probability, and use this as the code book estimate of the feedback path transfer function.

In a particular embodiment, typical time-development of feedback channels can be taken into account e.g. by using Hidden Markov Models (HMMs) or equivalent statistical tools. In this case, the GMM codebook described above would be extended with transition probabilities, i.e., probabilities for two code book entries to occur in succession. In a similar manner as described above, it is possible in this framework to find the codebook entry with the highest MAP probability or find the linear combination of code book entries leading to an MMSE estimate of the feedback path transfer function.

In an embodiment of the invention, the hearing instrument comprises one or more detectors (three, cf. 31-33, in FIG. 1*c*), adapted to decide which frequency regions of the feedback transfer function are reliable, and which may be unreliable, e.g. due to feedback, auto-correlation, etc. Using the reliable spectral regions of the estimated feedback transfer function, it is possible to find the 'closest' entry in the code book (or a suitable combination of the code book entries) and in this way obtain a plausible estimate of the feedback channel in the unreliable spectral regions. As a measure of a given feedback transfer function being reliable or unreliable, the following parameters or means can be used, e.g. (average) gains lower than, e.g. 0 dB, leads to an unreliable region, outputs of any auto-correlation detection algorithm, outputs of feedback-change detectors, the power level of the receiver (i.e. output) signal in a given frequency range, etc.

Figure 2:
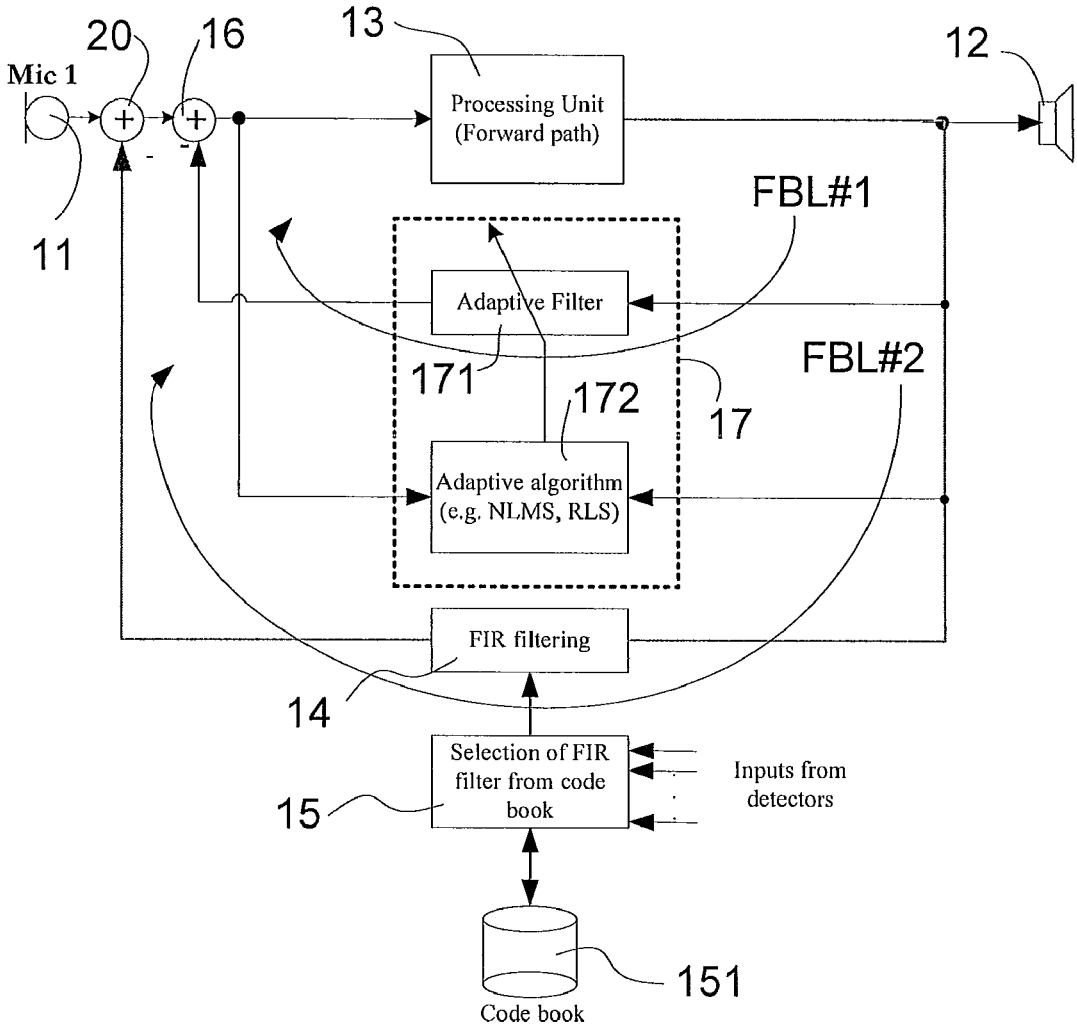
FIG. 2 shows a block diagram of a fourth embodiment of a hearing instrument according to the invention.
Figure 3:
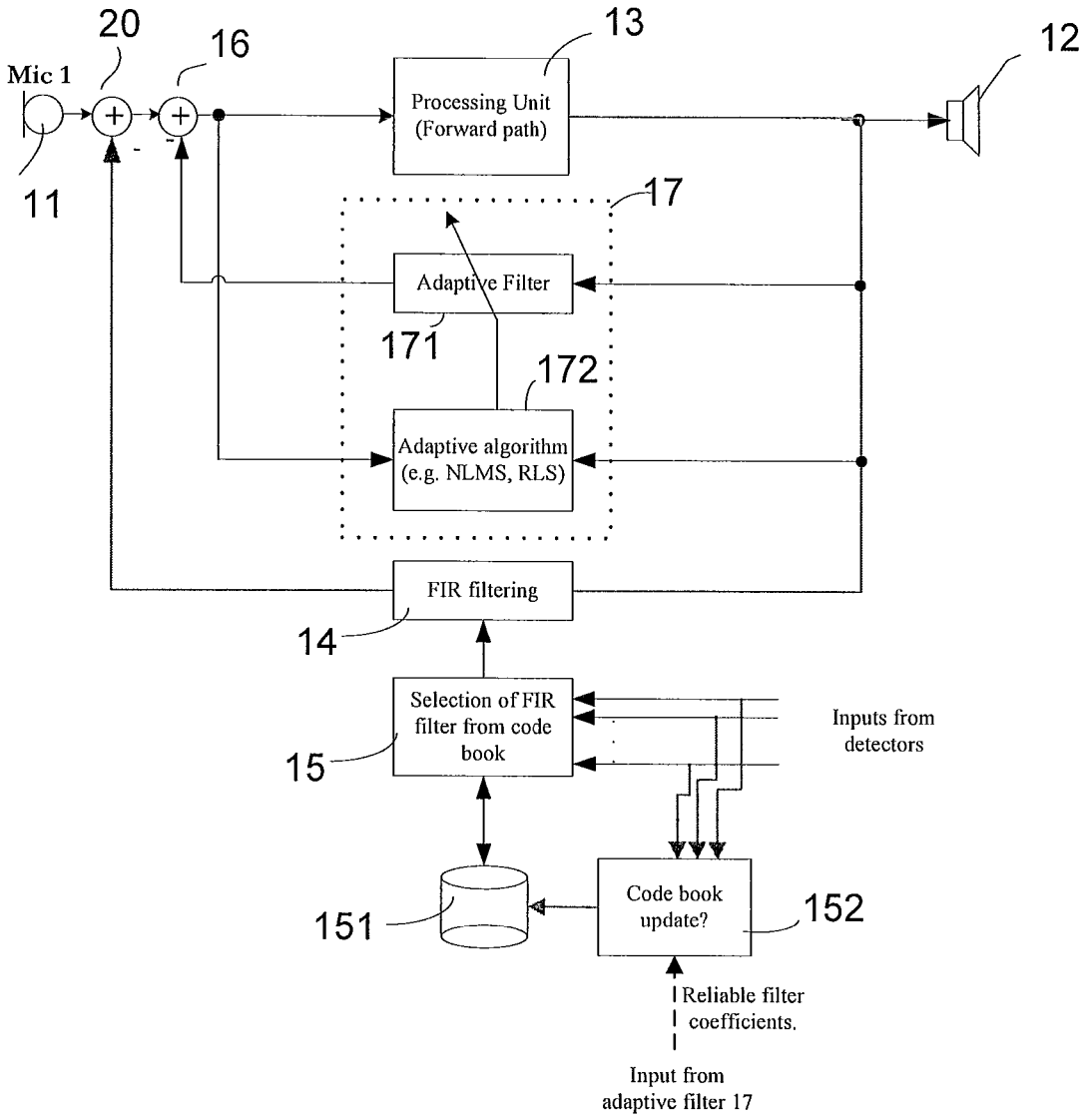
FIG. 3 shows a block diagram of a fifth embodiment of a hearing instrument according to the invention.

It may be that the collected (predetermined) feedback impulse responses give an overall picture of the instantaneous actual feedback channel, but cannot describe it in sufficient detail. In this case, it is still possible to use the pre-collected impulse responses, e.g. as shown in FIGS. 2 and 3, where the general trend of the feedback channel is eliminated using a feedback channel estimate from the pre-collected code book of impulse responses (cf. blocks 14, 15, 151 in FIG. 2 and 14, 15, 151, 152 in FIG. 3), while the finer details characterizing the instantaneous feedback channel are estimated and eliminated using standard algorithms (in the form of an adaptive FBC filter 17 working in a normal feedback cancellation mode in parallel to the codebook based adaptive filter). A simple but practically relevant special case of this is when the code book contains only a single impulse response estimate. This estimate could e.g. represent the static contribution to the feedback path from e.g. microphone, receiver, and A/D and D/A converters; this static contribution could be measured and stored during the fitting process.

FIG. 2 shows a block diagram of a fourth embodiment of a hearing instrument according to the invention. The embodiment of FIG. 2 comprises a forward path and an electric feedback loop as described in connection with FIG. 1. In the embodiment of FIG. 2, however, a specific adaptive FBC filter 17 (comprising an adaptive filter part 171 (Adaptive Filter block), whose filter characteristics can be customized by an algorithm part 172 (Adaptive algorithm (e.g. NLMS, RLS) block), is included in a separate feedback loop (FBL#1 in FIG. 2), for estimating the finer details of the feedback path, 'in parallel' to the loop (FBL#2 in FIG. 2) comprising the codebook filtering elements (blocks 14 (FIR filtering) and 15 (Selection of FIR filter from code book)) for estimating the more static parts of the feedback path. The monitoring unit 15 receives inputs from detectors indicating characteristics of the current acoustic environment, which are used by the monitoring unit to select an appropriate one of the impulse responses stored in the storage unit 151 of the hearing instrument.

As described, it is possible to determine the 'reliability' of a given estimate (whether found using a standard adaptive FBC approach, or with the help of a code book approach). If a given feedback channel estimate has been considered 'reliable' for a sufficient period of time, it is believed that it truly describes a physical feedback path, and it is therefore meaningful to update the existing codebook with this new information. Such changes can e.g. be due to changing conditions, a child's growth, generation of ear wax, etc. This can e.g. be implemented as shown in the embodiment in FIG. 3.

FIG. 3 shows a block diagram of a fifth embodiment of a hearing instrument according to the invention. The embodiment of FIG. 3 comprises a forward path and an electric feedback path comprising a first loop comprising an adaptive FBC filter 17 and a second loop comprising a variable pre-estimated filter 14 whose filter characteristics is adapted for being controlled by a selected one of a number of stored feedback channel impulse responses stored in storage unit 151 and controlled by monitoring unit 15 as described in connection with FIGS. 1 and 2. In the embodiment of FIG. 3, however, an update of the predetermined feedback channel impulse responses generated by code book update unit 152 and stored in the code book memory 151 is made possible via the monitoring unit 15 adapted for comparing the stored impulse responses with (e.g. average) actual values experienced over time. The latter are e.g. generated by the code book update unit 152 based on inputs from various detectors (as e.g. described in connection with the embodiment of FIG. 1*c*) and an input from the adaptive FBC filter 17 of the first feedback loop, the input e.g. comprising filter coefficients as determined by the FBC filter.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims. For example, the illustrated embodiments are shown to contain a single microphone. Other embodiments may contain a microphone system comprising two or more microphones, and possibly including means for extracting directional information from the signals picked up by the two or more microphones.

REFERENCES

Ali H. Sayed, Fundamentals of Adaptive Filtering, John Wiley & Sons, 2003, ISBN 0-471-5 46126-1

Simon Haykin, Adaptive Filter Theory, Prentice Hall, 3rd edition, 1996, ISBN 0-13-322760-X A. Kaelin, A. Lindgren and S. Wyrsch, A digital frequency-domain implementation of a very high gain hearing aid with compensation for recruitment of loudness and acoustic echo cancellation, Elsevier Signal Processing, Vol. 64, 1998, pp. 71-85.

WO 2008/051570 A1 (STARKEY LABS.) 2 May 2008

WO 01/06812 A1 (OTICON) 25 Jan. 2001

The invention claimed is:

1. A hearing instrument for processing an input sound to an output sound according to a user's needs, the hearing instrument comprising:

an input transducer for converting an input sound to an electric input signal;

an output transducer for converting a processed electric output signal to an output sound;

a forward path being defined between the input transducer and the output transducer, the forward path including an element for splitting the electric input signal into a plurality of frequency bands;

a feedback cancellation system for estimating an effect of acoustic feedback from the output transducer to the input transducer, the feedback cancellation system including a variable pre-estimated filter, a memory storing a number of predetermined feedback channel impulse responses corresponding to a number of acoustic environments where substantial feedback is experienced, and a feedback path estimation unit configured to dynamically estimate current acoustic feedback in the hearing instrument; and a monitoring unit that monitors the current acoustic environment and based on the current acoustic environment is configured to choose the currently most appropriate impulse response of the variable pre-estimated filter among the stored impulse responses, wherein the hearing instrument is configured to estimate acoustic feedback in at least one frequency band of the plurality of frequency bands by the feedback path estimation unit and configured to estimate acoustic feedback in at least another frequency band of the plurality of frequency bands by the variable pre-estimated filter.

2. A hearing instrument according to claim 1 adapted to apply the chosen currently most appropriate impulse response to the variable pre-estimated filter.

3. A hearing instrument according to claim 1 wherein the forward path comprises a signal processing unit adapted for providing a frequency-dependent gain and for providing a processed output signal.

4. A hearing instrument according to claim 1 adapted to determine frequency bands with signal energy below a predetermined value, and to estimate acoustic feedback by the variable pre-estimated filter in such frequency band(s) and by the feedback path estimation unit in the other frequency bands.

5. A hearing instrument according to claim 1 adapted to monitor the gain applied in one or more sub bands in the forward path and decide to use the feedback path estimate provided by the variable pre-estimated filter in spectral regions where the gain is below a certain threshold.

6. A hearing instrument according to claim 1 adapted to determine frequency bands that are reliable and frequency bands that are unreliable, and to estimate acoustic feedback in the reliable frequency bands by the feedback path estimation unit and to use the estimated feedback transfer function in the reliable frequency bands to find the most appropriate impulse response of the variable pre-estimated filter among the stored impulse responses and to use this to estimate the transfer function in the unreliable frequency bands.

7. A hearing instrument according to claim 1 wherein the feedback path estimation unit is implemented as an adaptive FBC filter.

8. A method of operating a hearing instrument for processing an input sound to an output sound according to a user's needs comprising:

converting an input sound to an electric input signal;

splitting the electric input signal into a plurality of frequency bands;

converting a processed electric output signal to an output sound;

estimating an effect of acoustic feedback from the output sound to the input sound;

providing said hearing instrument with a variable pre-estimated filter and a memory;

estimating a number of predetermined feedback channel impulse responses corresponding to a number of acoustic environments where acoustic feedback is experienced;

storing said predetermined feedback channel impulse responses in said memory;

monitoring the current acoustic environment; and choosing the currently most appropriate impulse response of the variable pre-estimated filter among the stored impulse responses from said memory based on the current acoustic environment, wherein said estimating the effect of acoustic feedback includes dynamically estimating acoustic feedback in at least one frequency band of the plurality of frequency bands, and estimating acoustic feedback in at least another frequency band of the plurality of frequency bands by said choosing the currently most appropriate impulse response of the variable pre-estimated filter.

9. A method according to claim 8, further comprising:

applying said chosen impulse response to the variable pre-estimated filter.

10. A method according to claim 8, wherein the step of dynamically estimating acoustic feedback is performed in parallel to the estimating the feedback path by the pre-estimated filter.

11. A method according to claim 8 comprising the use of statistical models on the pre-determined impulse responses by storing in the memory corresponding average impulse responses and variance of the impulse responses around their average.

12. A method according to claim 8, wherein the choosing the currently most appropriate impulse response is based on time-development of feedback channels.

13. A method according to claim 8 comprising the step of updating the predetermined feedback channel impulse responses stored in the code book memory.

14. A non-transitory computer-readable medium having instructions stored thereon, that when executed, cause a signal processor of a hearing instrument to perform a method comprising:

converting an input sound to an electric input signal by an input transducer of the hearing instrument;

splitting the electric input signal into a plurality of frequency bands;

converting a processed electric output signal to an output sound;

estimating an effect of acoustic feedback from the output sound to the input sound;

providing said hearing instrument with a variable pre-estimated filter and a memory;

estimating a number of predetermined feedback channel impulse responses corresponding to a number of acoustic environments where acoustic feedback is experienced;

storing said predetermined feedback channel impulse responses in said memory;

monitoring the current acoustic environment; and choosing the currently most appropriate impulse response of the variable pre-estimated filter among the stored impulse responses from said memory based on the current acoustic environment, wherein said estimating the effect of acoustic feedback includes dynamically estimating acoustic feedback in at least one frequency band of the plurality of frequency bands, and estimating acoustic feedback in at least another frequency band of the plurality of frequency bands by said choosing the currently most appropriate impulse response of the variable pre-estimated filter.

15. A hearing instrument according to claim 4 adapted to determine average signal energy or power within a frequency band by a 1-pole IIR long-term averaging filter applied to magnitude-squared time samples $|x_i(n)|^2$ within each sub band of the forward signal path.

16. A method according to claim 11 comprising the step of determining a minimum mean-square estimate or maximum a posteriori (MAP) estimate of the feedback channel impulse response based on the average impulse responses and the variance of the impulse responses around their average.

* * * * *